United States Patent [19]

Bochenek et al.

[11] 4,131,831

[45] Dec. 26, 1978

[54] DRAPERY OPENING AND CLOSING SYSTEM

[75] Inventors: Michael S. Bochenek, 7714 S. Meade, Burbank, Ill. 60459; Bradley X. Boyer, Chicago, Ill.

[73] Assignee: Michael S. Bochenek, Burbank, Ill.

[21] Appl. No.: 805,639

[22] Filed: Jun. 13, 1977

[51] Int. Cl.[2] ..... H01H 43/20

[52] U.S. Cl. ..... 318/282

[58] Field of Search ..... 318/282, 286, 466; 307/141, 117

[56] References Cited

U.S. PATENT DOCUMENTS

| | | | |
|---|---|---|---|
| 3,327,194 | 6/1967 | Trapp | 318/282 |
| 3,529,214 | 9/1970 | Corn | 307/117 |
| 3,714,457 | 1/1973 | Sweeney | 307/141 |

*Primary Examiner*—Herman J. Hohauser

*Attorney, Agent, or Firm*—Hill, Gross, Simpson, Van Santen, Steadman, Chiara & Simpson

[57] ABSTRACT

A drapery opening and closing system is provided for draw drapes which are movable over a traverse member between an open and closed position by use of a drape drive system. The opening and closing system has limit switches positioned to be activated when the drapes are opened and closed. A manually settable timer connected to a power source applies power at preset times to a reversible motor via a control circuit. The control circuit is comprised of a relay activated by the timer and a series connected two-section switch. Outputs of the two-section switch are connected to the reversible motor through the limit switches. When the timer is triggered at a preset time, the drapes automatically open or close. Via the two-section switch, the drapes may be manually activated to open or close at times other than the preset times on the timer.

3 Claims, 4 Drawing Figures

Fig. 1
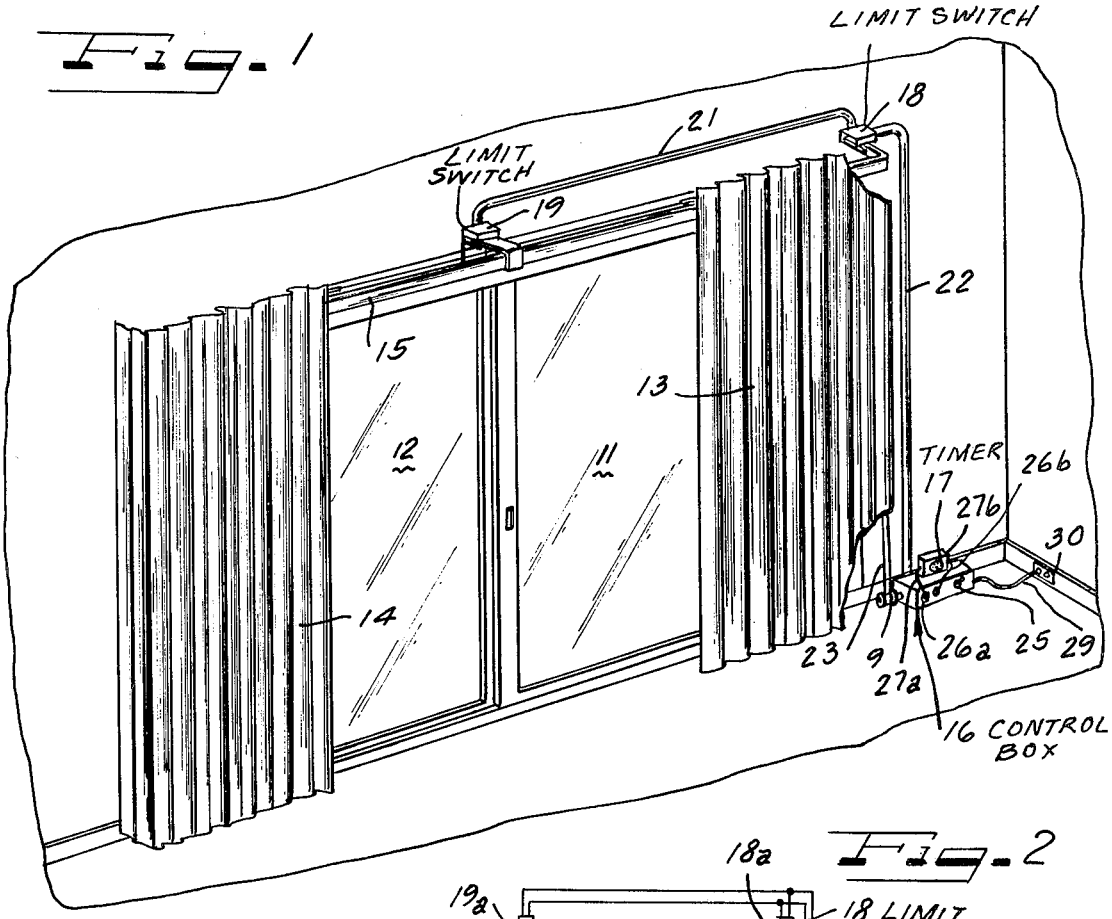
Fig. 2
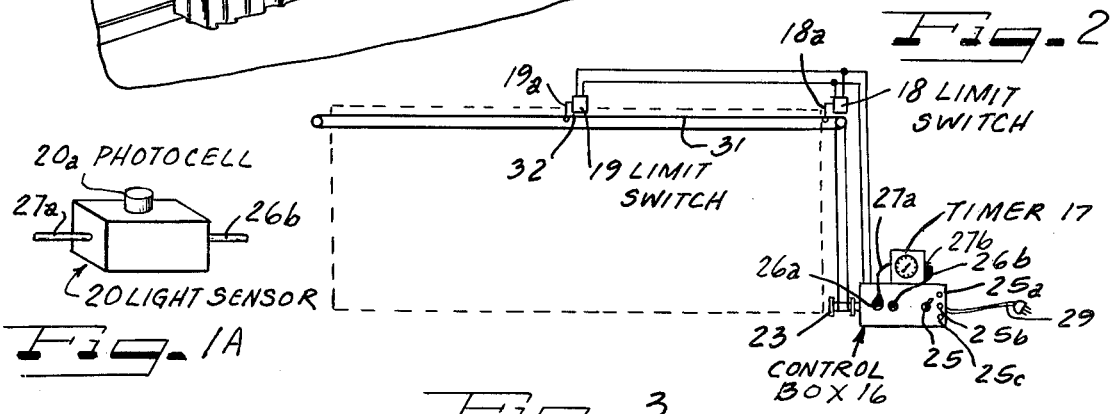
Fig. 1A
Fig. 3
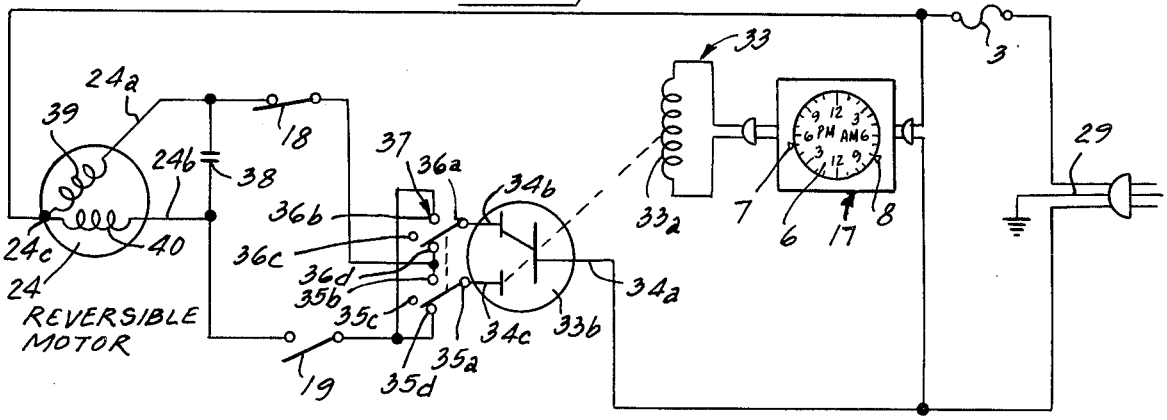

DRAPERY OPENING AND CLOSING SYSTEM

BACKGROUND OF THE INVENTION

1. Field of the Invention

This invention relates to motor driven drapery systems.

2. Description of the Prior Art

Motor driven drapery systems are known. With such systems it is necessary to manually operate a driving motor to open or close the drapes.

It is desirable to provide an automatic system in which a manual activation of the driving motor is not necessary. Furthermore, it is desirable to provide a system which is responsive to the time of day or light conditions since it is desirable that the drapes be closed during darkness hours and open for daylight hours.

SUMMARY OF THE INVENTION

It is an object of the present invention to provide an automatic drapery opening and closing system which automatically opens or closes the drapes in accordance with the time of day and/or the ambient light conditions at a window.

It is a further object of this invention to provide an automatic drapery opening and closing system in which an automatic opening and closing of the drapes can be overriden by a manual activation of the opening or closing operation.

It is another object of this invention to provide a drapery opening and closing system in which a conventional AC timer unit may be employed for automatically opening and closing the drapes.

According to the invention, a reversible motor is mechanically connected to a drape drive system for draw drapes which are movable over a traverse member between an open and closed position. A first limit switch is activated when the drapes are opened and a second limit is activated when the drapes are substantially closed. A conventional AC timer is connected to a power source and applies and disconnects power from the power source to a control circuit at predetermined times depending upon a manual setting of the timer. The control circuit has a relay whose coil is energized by the timer. The contacts of the relay are connected to the power source and, depending upon the position of the relay contacts, supply power through a two-section manual function switch to either a clockwise rotation power terminal or a counterclockwise rotation power terminal of the reversible motor. Limit switches are provided between the counterclockwise and clockwise terminals of the motor and each section of the two-section manual switch. A common power terminal of the reversible motor connects to the power source.

When a predetermined time occurs, the relay is activated to supply power through one of the sections of the switch and through one of the limit switches to the reversible motor. When the drape attains its open or closed position, the appropriate limit switch opens, thus cutting off power to the motor. The manual switch has an off position and two additional positions by which an operator of the system may manually intervene to open or close the drapes at times other than those preset on the timer.

A commercially available light sensitive switch may be provided as a substitution for the timer, thus controlling the reversible motor in response to ambient light condition.

BRIEF DESCRIPTION OF THE DRAWINGS

FIG. 1 is a perspective view of the drapery opening and closing system of this invention;

FIG. 1A shows a light sensitive switch that can be used in an embodiment of the invention.

FIG. 2 is a front view showing the drapery opening and closing system of FIG. 1 with the drapes removed; and FIG. 3 is a schematic diagram of the drapery opening and closing system of this invention.

DESCRIPTION OF THE PREFERRED EMBODIMENTS

The drapery opening and closing system of this invention is shown generally at 10 in FIG. 1. Drapes 13 and 14 are shown which are movable on a traverse rod 15 mounted above the sliding glass doors, for example. The drive pulley 23 alongside the sliding glass door 11 moves the drapes 13 and 14 along the traverse rod 15.

As shown in both FIGS. 1 and 2, a control box 16 is provided having a commercially available timer 17. The control box is securely fastened to the floor and has a gear 9 connected to the drive pulley system 23 of the drapes for opening and closing movement thereof.

Normally closed limit switches 18 and 19 are mounted adjacent the traverse rods, the switch 18 being positioned at one end of the traverse rod and the switch 19 being positioned approximately in the middle of the traverse rod 15. A commercially available light sensing switch 20 may be used in place of the timer 17 and is directly or indirectly exposed to light levels received through the window via a photocell **20*a***. The light sensor now provides the input for the relay coil.

As shown most clearly in FIG. 2, the control box has a three position manual toggle switch 25 with a central off position **25*b* and manual opening or closing positions 25*a* and 25*c*. The power cable 29 connects the control box 16 to a wall outlet 30**.

The timer 17 has an AC input cable **27*a* with a plug which is matable with a receptacle 26*a* in the control box 20. An AC output receptacle 27*b* mounted on the timer 17 receives a plug on a cable 26*b* connected to the control box 16**.

A drape cord 31, shown in FIG. 2, is connected to the drape and has a knot 32 or other obstruction for engagement against a lever arm **19*a* of the normally closed limit switch 19. Similarly, a lever arm 18*a* of limit switch 18 is mounted adjacent the cord 31 and is activated when the drapes are open and the knot 32 moves the lever arm 18*a***.

As shown in FIG. 3, one side of the AC line from power cable 29 connects through a fuse 3 to the timer 17. The other side of the AC line cable 29 connects directly to the timer input so that AC power is continuously applied.

The timer 17 is a conventional unit well known in the art and may have adjustment levers 7 and 8 opposite a rotating wheel 6 having time intervals marked thereon. The levers 7 and 8 are set adjacent to the time at which it is desired that the timer connect or disconnect AC power therethrough to a relay 33.

The relay 33 has an AC coil **33*a* energized by power through the timer 17. When the coil 33*a* is energized, the control arm 34*a* of a three terminal switch 33*b* is switched to position 34*b* as shown. Consequently, AC power is then connected to one of the sections of a double-pull double-throw manual function switch 37**.

The switching terminal 36a in one of the sections may be manually switched to either an open drape position 36d or a closed drape position 36b, respectively. A central terminal 36c is provided as an off condition and is left blank.

As shown in the drawing, AC power is then connected by the manual switch 37 through the drape open limit switch 18 to a clockwise rotation terminal 24a of a reversible motor 24 which opens the drapes. When the drapes are fully opened, the normally closed limit switch 18 opens and power to the reversible motor is disconnected.

In similar fashion, when the timer de-energizes the relay coil 33a, the relay switch 33b connects power from terminal 34a to terminal 34c and hence into the second section of the two section manual switch 37 at a central pole 35a. Assuming that the manual switch is in the down position shown, power is connected from terminal 35a to 35d and hence is connected to a terminal 24b of reversible motor 24 which causes a counterclockwise rotation of the reversible motor and consequent closing of the drapes until a limit switch 19 opens.

The reversible motor 24 has a common terminal 24c which completes the current flow path back to the power source cable 29 through a fuse 3. The reversible motor may typically be a bi-directional capacitor motor having two windings 39 and 40 for clockwise and counterclockwise operation of the motor, respectively. A capacitor 38 provided between the counterclockwise terminal 24b and clockwise terminal 24a provides the proper phase shift between the clockwise and counterclockwise windings 39 and 40. However, any bidirectional motor with three terminals including a common terminal could be used with this system.

In another embodiment of this invention as shown in FIG. 1A, a light sensitive switch 20 may be connected in place of the timer with the same cable connections as described previously. Such light sensitive switches are well known in the art and are commercially available in a variety of forms for controlling AC appliances in response to varying load conditions.

With the connection of the light sensitive switch 20, when daylight occurs the light sensitive switch opens the drapes and closes them when darkness occurs.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A drapery opening and closing system for draw drapes movable over a traverse means between an open and closed position by use of a drape drive system, comprising:

(a) drape traverse means;

(b) a drape cord pully system connecting to the traverse means and extending downwardly with respect to the traverse means;

(c) a first limit switch means positioned to be activated when said drapes are opened;

(d) a second limit switch means positioned to be activated when said drapes are substantially closed;

(e) a power source;

(f) a timer means connected to the power source for applying and disconnecting power from the power source at predetermined times;

(g) a control circuit means positioned at a lower end of the pulley system, comprising:

(i) a reversible motor electrically connected to the power source and mechanically connected by a drive pulley to the lower end of the pulley system and having power input terminals for clockwise rotation and counterclockwise rotation;

(ii) an automatic switching means activated by power from the timer means;

(iii) a manual switching means and said first and second limit switch means each forming a series circuit with the automatic switching means, said series circuit being connected between the power source and the clockwise and counterclockwise power input terminals of the reversible motor; and (h) said control circuit means automatically opening and closing the draw drapes at predetermined times as set by the timer means, said control circuit means turning off the system or opening and closing the drapes independent of of the times set on the timer means when the manual switching means is operated, and said control circuit means turning off the system automatically when said first and second limit switch means are activated when the drapes are respectively fully opened and substantially closed.

2. A drapery opening and closing system for draw drapes movable over a traverse means between an open and closed position by use of a drape drive system, comprising:

(a) drape traverse means;

(b) a drape cord pulley system connecting to the traverse means and extending downwardly with respect to the traverse means;

(c) a first limit switch means positioned to be activated when said drapes are fully open;

(d) a second limit switch means positioned to be activated when said drapes are substantially closed;

(e) an AC power source having first and second conductors;

(f) an AC timer means having an AC input connected to said first and second AC power source conductors and an AC output, said timer means automatically switching power from the AC input on and off at manually settable times;

(g) a reversible motor mechanically connected by a drive pulley to a lower end of said drape cord pulley system and having a common terminal connected to said first AC power conductor, a clockwise rotation terminal and a counterclockwise rotation terminal;

(h) an AC relay having a coil and a three terminal switch, said coil being connected to said timer means AC output and one of the three terminals of the switch being connected to the first AC power source conductor;

(i) a two section manual switch, the two sections being respectively connected to the other two terminals of the AC relay, said manual switch having two rest positions;

(j) the first and second limit switch means each being connected to both sections of the manual switch; and (k) the motor clockwise and counterclockwise rotation terminals being respectively connected to the first and second limit switch means, the limit switch means stopping the motor when the drapes are fully opened and substantially closed.

3. A drapery opening and closing system for draw drapes movable over a traverse means between an open and closed position by use of a drape drive system, comprising:

(a) drape traverse means;

(b) a drape pulley system connecting to the traverse means and extending downwardly with respect to the traverse means;

(c) a first limit switch means positioned to be activated when said drapes are opened;

(d) a second limit switch means positioned to be activated when said drapes are substantially closed;

(e) a power source;

(f) a light sensing means connected to the power source for applying and disconnecting power from the power source at predetermined light levels;

(g) a control circuit means positioned at a lower end of the pulley system, comprising:

(i) a reversible motor electrically connected to the power source and mechanically connected by a drive pulley to the lower end of the pulley system and having power input terminals for clockwise rotation and counterclockwise rotation;

(ii) an automatic switching means activated by power from the light sensing means;

(iii) a manual switching means and said first and second limit switch means each forming a series circuit with the automatic switching means, said series circuit being connected between the power source and the clockwise and counterclockwise power input terminals of the reversible motor; and (h) said control circuit means automatically opening and closing the draw drapes at predetermined light levels as set by the light sensing means, said control circuit means turning off the system or opening and closing the drapes independent of the light levels determined by the light sensing means when the manual switching means is operated, and said control circuit means turning off the system automatically when said first and second limit switch means are activated when the drapes are respectively fully opened and substantially closed.

* * * * *